US005163583A

United States Patent [19]

Whitworth

[11] Patent Number: 5,163,583

[45] Date of Patent: Nov. 17, 1992

[54] ASPIRATION CAP FOR DISPENSING BLOOD OR OTHER FLUIDS FOR DIAGNOSTIC PURPOSES

[76] Inventor: Ted N. Whitworth, 4839 Industrial Park, Royse City, Rockwall County, Tex. 75089

[21] Appl. No.: 816,279

[22] Filed: Jan. 3, 1992

[51] Int. Cl.[5] ..... B65D 37/00; B67D 5/00

[52] U.S. Cl. ..... 222/1; 222/82; 222/209; 222/420; 604/407; 604/411; 604/415

[58] Field of Search ..... 222/1, 81, 82, 83, 89, 222/209, 211, 214, 420, 563; 604/407, 411, 415

[56] References Cited

U.S. PATENT DOCUMENTS

| | | | |
|---|---|---|---|
| 1,557,836 | 10/1925 | Hein . | |
| 2,019,240 | 10/1935 | Van Der Woerd | 222/211 X |
| 2,771,074 | 11/1956 | Landsperger et al. | 128/276 |
| 3,124,280 | 3/1964 | Stull | 222/563 X |
| 3,366,278 | 1/1968 | Fobes | 222/82 |
| 3,369,708 | 2/1968 | Hein | 222/89 X |
| 3,580,423 | 5/1971 | Gilman | 222/81 |
| 3,788,528 | 1/1974 | Ogle | 222/420 X |
| 3,977,568 | 8/1976 | Smith | 222/80 |
| 4,234,103 | 11/1980 | Strobl, Jr. et al. | 222/83.5 |
| 4,331,147 | 5/1982 | Armstrong | 604/415 X |
| 4,411,661 | 10/1983 | Kersten | 604/411 |
| 4,811,866 | 3/1989 | Golias | 222/189 |
| 4,856,533 | 8/1989 | Anraku et al. | 604/415 X |
| 5,048,705 | 9/1991 | Lynd et al. | 222/211 |

FOREIGN PATENT DOCUMENTS

| | | | |
|---|---|---|---|
| 454628 | 1/1950 | Italy | 222/420 |

*Primary Examiner*—Kevin P. Shaver
*Attorney, Agent, or Firm*—Richards, Medlock & Andrews

[57] ABSTRACT

A dispenser cap for use with a fluid container having an aperture through a flexible portion of a stopper closing the mouth of the container comprises a main body portion and a fluid communicating spike extending through the body portion. The spike has an outer diameter of sufficient size to form a seal with and to permit flexing of the flexible portion of the container stopper upon insertion of the spike in the stopper and upon movement of the cap toward the flexible portion of the stopper. The main body portion of the dispenser cap comprises a disk portion with a skirt extending from the disk portion and circumferentially encircling the container stopper.

39 Claims, 2 Drawing Sheets

ASPIRATION CAP FOR DISPENSING BLOOD OR OTHER FLUIDS FOR DIAGNOSTIC PURPOSES

TECHNICAL FIELD OF THE INVENTION

The present invention relates to a cap for use in conjunction with a liquid containing vial for dispensing such liquid in minute portions, such as in droplets, and more specifically to a cap for dispensing a drop of blood for diagnostic purposes.

BACKGROUND OF THE INVENTION

In patient care and medical research facilities, it is often necessary to dispense a small amount of blood or other fluid for purposes of testing. These fluids are often carried in various containers, many of which have an open mouth that is sealed by a rubber or other flexible stopper. Removal of the fluid from the container is often accomplished by first removing the stopper and then withdrawing, such as by use of a pipette, an amount of fluid from the container for deposit onto a slide or in some other way applied for testing. Where the container is opened, and a pipette used to withdraw the fluid, it is difficult to prevent inadvertent spattering or spillage. Thus, the healthcare worker is unnecessarily exposed to infection where infectious fluids are being tested.

One way of withdrawing fluid from these containers without removing the container cap is by use of a syringe and needle which can be inserted through the rubber cap and into the container for withdrawing of a small amount of blood or other fluid. However, the use of a syringe and needle is cumbersome and expensive and further exposes the healthcare worker to the possibility of needle pricks which can be particularly injurious where infectious fluids are being handled.

These procedures particularly increase the potential exposure of healthcare workers to the Human Immunodeficiency Virus-1 (HIV-1) which may be transmitted to the healthcare worker through infected blood. While various dispensers have been used in the past, none provide a method of easily, economically and safely dispensing a droplet of fluid from a container. The patent to Robert W. Ogle, U.S. Pat. No. 3,788,528, shows a device having a cap adapter which operates in conjunction with a specialized stopper having an existing opening therethrough. The patent to R. S. Fobes, U.S. Pat. No. 3,366,278, discloses a dispenser for liquid biologicals having an elongated tube with one end for insertion through a rubber stopper closing a container and an abutment plate for engagement with the rubber stopper for applying a pumping action to the stopper. A pumping action is caused by the engagement of the plate against the stopper.

Other devices, such as that shown in the patent to Tipton Golis, U.S. Pat. No. 4,811,866, require the use of a special dispensing nozzle which generally would require the removal of the container stopper and the application of a resilient dispensing member. A pumping action is achieved by flexing the resilient nozzle by squeezing. This device would be relatively expensive to manufacture and is not readily adaptable to all configurations of containers used. Further, prior to application of the dispenser member, the blood or other fluid within the container is exposed for possible spillage and thereby contact with the healthcare worker.

SUMMARY OF THE INVENTION

The present invention provides a simple, inexpensive and safe dispenser cap which overcomes many of the limitations heretofore found in prior devices. In one embodiment of the invention a dispenser cap is provided for use with a fluid container having an aperture through a flexible portion of the container. The cap is used for dispensing fluid from the container through the aperture and comprises a main body portion and a fluid communicating spike extending through the body portion. The spike has an outer diameter of sufficient size to form a seal with and to permit flexing of the flexible portion of the container upon insertion of the spike in the container and upon movement of the cap against or toward the flexible portion of the container.

In a more specific embodiment of the invention, a cap is used for dispensing a drop of blood from a container into which blood is collected for purposes of testing. One such container is currently marketed by Becton Dickinson Vacutainer Systems, Rutherford, N.J. 07070 under the trademark "Vacutainer." The Vacutainer container consists of a glass tube having a flexible rubber stopper for closing the mouth of the tube to maintain a vacuum therein. Blood is drawn from a patient using the vacuum within the container upon piercing the rubber stopper and exposing the vacuum to a line connected to a needle which is inserted into the patient's vein. After a blood sample has been collected, the present invention is used to dispense a drop or more of blood from the container for testing. In this embodiment of the invention, a dispenser cap comprises a main body including a disk portion with a skirt extending from the disk portion to form a cap. A fluid communicating spike extends through and is formed integrally with the disk portion and defines a fluid passage therethrough. The spike has an outer diameter of sufficient size to penetrate the existing opening in the flexible cap of the stopper on the Vacutainer container. This opening in the cap is formed in a flexible diaphragm portion of the cap. The spike is of a sufficient size relative to the opening in the cap such that a seal is formed therebetween.

Upon inserting the fluid communicating spike into the stopper, the disk portion of the cap confronts the upper end of the stopper and the skirt of the cap overlies and circumferentially encircles the sides of the stopper. Upon inverting the Vacutainer such that blood covers the stopper end and surrounds the end of the fluid communicating spike which has penetrated the stopper, and upon applying a slight axial force to the cap such that the flexible membrane of the stopper is moved inwardly, a single drop of blood may be expelled from the container through the fluid passage in the dispensing cap.

The force applied to the cap need not be applied to the full face of the cap. Rather, a blood drop may be easily expelled from the container by applying an axial force to one side of the dispenser cap sufficient to cause the cap and the flexible portion of the stopper of the Vacutainer to move inwardly.

In one embodiment of the invention, the dispenser cap has reinforcing ribs formed integrally with the skirt to reinforce the skirt sidewalls of the device.

In another aspect the invention provides a method of dispensing an amount of fluid from a fluid container having a resilient stopper in the mouth thereof with a first portion of the stopper overlying the lip which forms the mouth of the container and having a flexible portion inwardly of the first portion, the method comprising: positioning a dispensing cap on the stopper, the dispensing cap having a cap body engaging the first portion of the stopper to entrap the stopper between the lip of the container and the cap and simultaneously inserting a fluid communicating spike extending from the cap body and defining a fluid passage therethrough into the flexible portion of the stopper, the spike having an outer diameter of sufficient size to penetrate the flexible portion of the stopper and form a seal with the flexible portion of the stopper capable of moving the flexible portion of the stopper as the spike is moved, and applying a pressure on the cap to move it axially toward the container and simultaneously move the spike axially into the container to flex the flexible portion of the stopper to dispense fluid from the container. The method can further comprise the step of engaging the cap against the first portion of the stopper to compress the first portion of the stopper between the lip of the container and the cap as the cap is moved axially toward the container.

BRIEF DESCRIPTION OF THE DRAWINGS

For a more complete understanding of the present invention, and for further details and advantages thereof, reference is now made to the following Detailed Description taken in conjunction with the accompanying drawings, in which.

DESCRIPTION OF THE PREFERRED EMBODIMENTS

Figure 1:
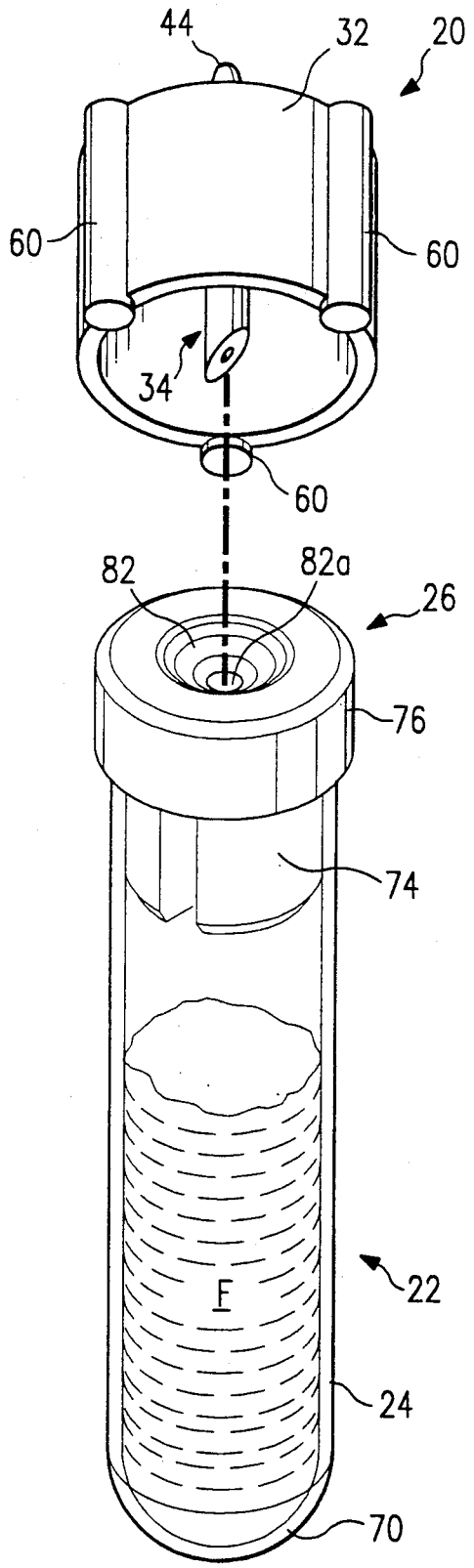
FIG. 1 is a perspective view of the dispenser cap of the present invention shown separated from a fluid container on which it is used.

Referring to the drawings which illustrate the preferred embodiments of the invention in greater detail, FIG. 1 shows the dispenser cap 20 of the present invention in perspective view. Cap 20 is designed for use in conjunction with a fluid vial 22 which includes a fluid container 24 with a resilient stopper 26 for closing the mouth of the container.

Figure 2:
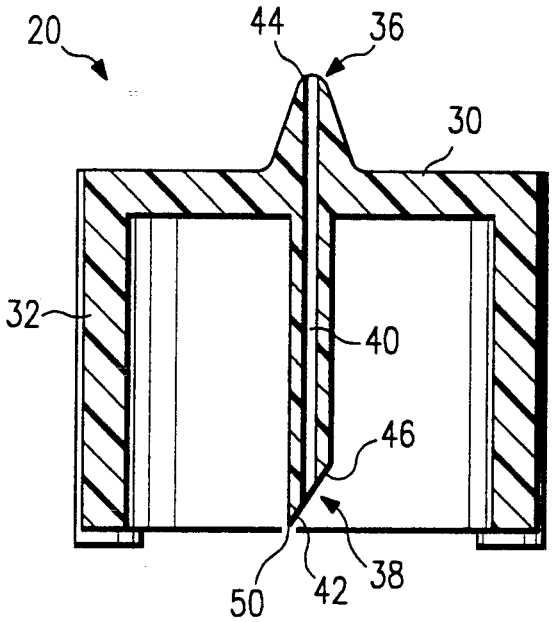
FIG. 2 is a vertical section view of the dispenser cap of the present invention.

Referring to FIG. 1 in conjunction with FIG. 2 which is a vertical section view of cap 20, cap 20 includes a circular disk portion 30 having a circumferential skirt 32 extending therefrom and formed integrally therewith. A spike tube 34 having a dispensing end 36 and a vial penetrating end 38 is formed and extends integrally from disk portion 30. A fluid passage 40 is formed within spike tube 34 and extends from entry tip 42 at the distal end of penetrating end 38 to the dispensing tip 44 of dispensing end 36. The entry tip 42 has an inclined surface 46 which forms a penetrating point tip 50.

In one form of the present invention, the dispenser cap 20 is injection molded from polypropylene. Those skilled in the art will recognize that other plastics may be used such as polyethylene or polystyrene. Further, materials other than plastics may also be used. As can be best seen in FIG. 1, cap 20 has three equally spaced reinforcing ribs 60 which are formed as a part of skirt 32 to provide rigidity to the skirt and to facilitate molding. As seen in FIG. 2, the circumferential skirt 32 extends outwardly from the circumference of the inner side of circular disk portion 30 in a direction at least generally parallel to the longitudinal axis of spike tube 34 a distance which is at least as great as the length of the penetrating end 38.

Referring to FIG. 2, in one embodiment of the invention, fluid passage 40 is 0.030 inch (0.077 cm) in diameter. The outer diameter of spike tube 34 is approximately, 0.094 inch (0.241 cm). It will be understood that these dimensions are merely by way of illustration of dimensions which will achieve the intended results of the present invention but are not intended to be limiting and may be varied as necessary to tailor the device to the particular application and fluid to which it is applied.

Figure 3:
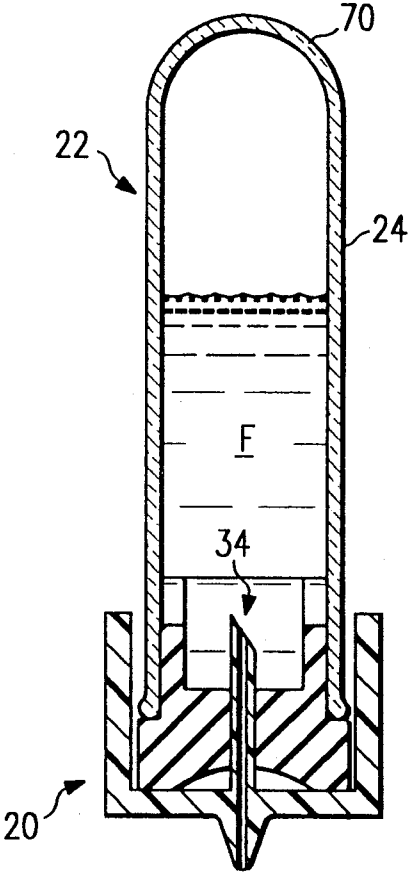
FIG. 3 is a vertical section view of the dispenser cap of the present invention shown attached to a fluid container.

Referring again to FIG. 1, a fluid vial 22 may be one of many containers in which fluid F is collected for diagnostic purposes. The present invention is particularly adapted to use with a fluid container sold under the trademark "Vacutainer" by Becton Dickinson Vacutainer Systems, Rutherford, N.J. 07070. These containers include a glass container 24 having a closed lower end 70 and an open mouth 72 which is closed by stopper 26. Stopper 26 has a reduced circumferential portion 74 Which may be inserted into container 24 and an enlarged circumferential portion 76 which, upon insertion of the stopper into container 24, engages the uppermost lip 80 of glass container 24 (FIG. 3). Stopper 26 also has a flexible diaphragm portion 82, which is located inwardly of the outer portion of stopper 26 which overlies the lip 80.

These containers are specifically designed for receiving blood samples. The Vacutainer containers are provided with stopper 26 in place on container 24 and with a vacuum therein. Blood samples are drawn by exposing the vacuum to a fluid line by way of a needle inserted into diaphragm 82 and connected to a tube which communicates with the patient by way of a needle inserted into the patient's vein. This procedure produces a small hole in the diaphragm portion 82 of stopper 26 by the use of a 15 gauge to 20 gauge needle. Once blood has been collected in the container, the needle inserted into the diaphragm portion 82 is removed leaving an aperture 82*a*. The resiliency of the material of stopper 26 causes the opening to close. These blood samples are then delivered to diagnostic laboratories for purposes of evaluation.

Figure 5:
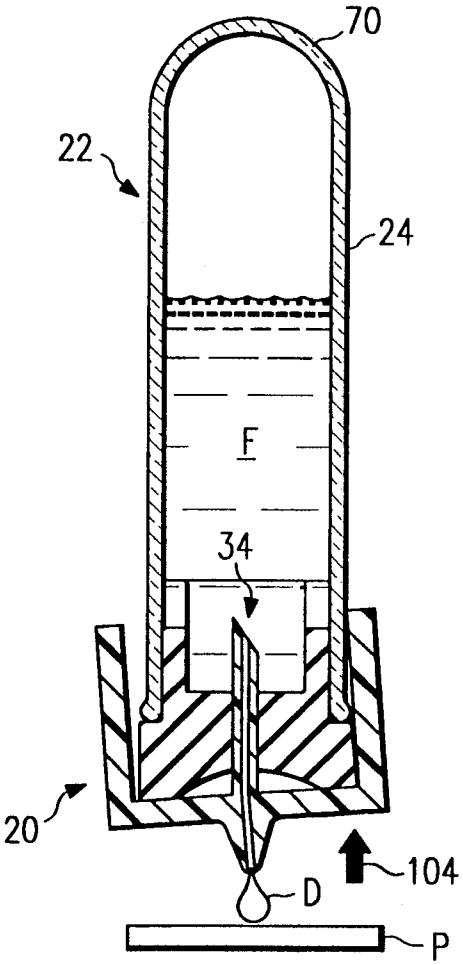
FIG. 5 is a vertical section view similar to FIG. 3 but showing an alternative movement of the dispenser cap according to the present invention to expel fluid from the container.
Figure 4:
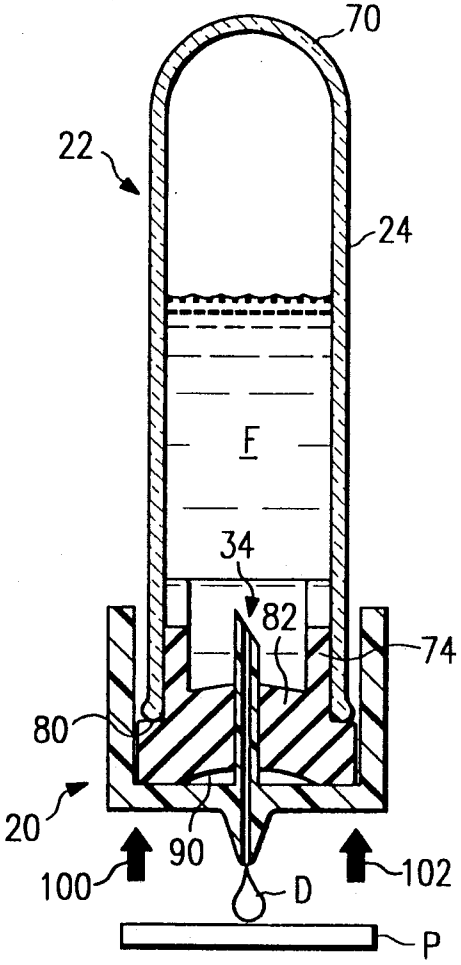
FIG. 4 is a vertical section view similar to FIG. 3 but showing the movement of the dispenser cap according to the present invention whereby fluid may be expelled from the fluid container.

With the present invention, the need to remove stopper 26 to withdraw blood from the container is eliminated. In use of the present invention, which use is shown in FIGS. 3–5, dispenser cap 20 is engaged over stopper 26 with spike tube 34 inserted into opening 82*a* in diaphragm portion 82. As can be seen in FIG. 3, spike tube 34 is of sufficient length such that with cap 32 fully seated on stopper 26, it extends through and emerges for exposure into the interior of the container. Penetrating point tip 50 facilitates the passage of spike tube 34 into and through diaphragm portion 82 of stopper 26.

In view of the material from which stopper 26 is made and the outside diameter of spike tube 34, which dimension may be adjusted as required to insure a seal therebetween, no leakage will be experienced between the outside surface of spike tube 34 and stopper 26. In the event some leakage does occur, the blood or other fluid is entrapped within the skirt 32 and disk portion 30.

As can be seen in FIG. 3, skirt 32 overlies and circumferentially encircles the enlarged circumferential portion 76 of stopper 26. In a preferred embodiment, there is a slight clearance therebetween, although such a clearance is not required. Cap 20 may be fully seated on stopper 26 by slightly rotating the cap either during or after insertion of spike tube 34 into aperture 82*a* of stopper 26. As can be seen in FIG. 3, in view of the design of stopper 26 and cap 20, a void 90 exists between diaphragm portion 82 of stopper 26 and the inside upper wall of disk portion 30 of cap 20. Thus, in the fully seated position, as illustrated in FIG. 3, a first, peripheral portion of the circular disk portion 30 of cap 20 overlies and engages the outer portion of stopper 26 which overlies lip 80 of container 24 to entrap the outer portion of the stopper 26 between the lip 80 and the circular disk portion 30, while a second portion of the circular disk portion 30, located inwardly of the first, peripheral portion remains spaced apart from the flexible diaphragm portion 82 of stopper 26.

Once cap 20 has been fully seated onto stopper 26, the assembled cap and fluid container are inverted to the position shown in FIGS. 3–5. A drop of blood or other fluid D may be easily dispensed or aspirated from the assembly as shown in FIG. 3 by simply axially moving cap 20 toward the container, as shown in FIG. 4. The axial pressure which is applied is illustrated by arrows 100. Stopper 26 may easily be compressed by such axial movement. As can be seen in FIGS. 3–5, stopper 26 is entrapped between lip 80 and cap 20 to facilitate applying such compression. The seal between spike tube 34 and diaphragm portion 82 of stopper 26 is sufficient to cause diaphragm portion 82 to move slightly inwardly, as shown in FIG. 4. This inward movement, which is shown in slightly exaggerated form for purposes of clarity, causes a drop of blood to be expelled through fluid passage 40 for application to a diagnostic plate P. Of course, the blood or other fluid expelled may be applied in any other way as dictated by the particular test being conducted.

It has been found that the present invention provides very accurate control of the drop of blood or fluid which is expelled. Indeed, before the drop is fully expelled, it may be withdrawn back into the container by simply releasing the axial pressure applied to cap 20. This release of pressure allows stopper 26, which has been compressed, to expand and to move cap 20 outwardly, simultaneously moving diaphragm portion 82 to its at rest position. The engagement of cap 20 with the full face of stopper 26 and the compression thereof by applying axial force to the cap, uses the elasticity of the stopper to serve as a restoring spring. This arrangement, in conjunction with the sealing contact between spike 34 and diaphragm portion 82, produces a pump which can be used to effectively control dispensing either a single or multiple drops of blood or fluid from the container.

Additionally, the present invention conveniently provides for the dispensing of a drop of blood by simply applying an axial force to one side of cap 20, as shown in FIG. 5 and as illustrated by arrow 102. In this illustration, it is shown that the application of a force as illustrated by arrow 102 causes compression of one side of stopper 26 and movement of diaphragm portion 82 slightly into the chamber defined within vial 22. This operates to expel a single drop of blood as illustrated.

As can be seen in FIG. 5, the inside diameter of skirt 32 is sufficient to permit off axis movement of cap 20 such that it rotates slightly by virtue of axial force applied to only one side of the cap. This permits the container to be held in the palm of the hand while applying pressure to cap 20 using only the thumb or forefinger to expel a drop of blood. Thus, the present invention allows for single hand operation.

The present invention provides a simple, inexpensive and highly effective dispenser cap for dispensing blood and other fluids in minute amounts. The dispenser cap may be injection molded at a fraction of the cost of a needle and syringe which might otherwise be used to withdraw blood from the container. Thus, the dispenser cap is a disposable item which may be left on the blood container for disposal with it. Likewise, the fluid passage 40 is of a sufficiently small size that after use, blood which is retained within the passageway seals the passage to fully close off the container. Thus, the present invention provides an optimum way of handling blood or other potentially infectious materials in such a manner as to minimize splashing, spraying, or spattering of these substances in a way which would expose healthcare workers to the potentially harmful substances.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. For example, the dimension of the spike tube 34 and passage 40 may be adjusted as required for optimum operation. Similarly, the material from which the dispenser cap is made may be adjusted as desired. Accordingly, the present invention is intended to encompass such rearrangements, modifications and substitutions of parts and elements as fall within the spirit and scope of the invention.

I claim:

1. A method of dispensing an amount of fluid from a fluid container having a lip which forms a mouth and having a resilient stopper closing said mouth, a first portion of the stopper overlying said lip, a second portion of said stopper being disposed inwardly of said first portion and being flexible, said method comprising:

positioning a dispensing cap over the stopper, the dispensing cap having a cap body portion engaging the first portion of the stopper to entrap the first portion of the stopper between the lip of the container and the cap body portion and simultaneously inserting into and through said second portion of the stopper a fluid communicating spike extending from the cap body portion and defining a fluid passage therethrough, said spike having an outer diameter of sufficient size to penetrate said second portion of the stopper and form a seal with the second portion of the stopper capable of moving the second portion of the stopper inwardly of said container as the spike is move toward the interior of said container, and applying a pressure on the thus positioned dispensing cap to simultaneously move said dispensing cap at least substantially axially toward the container and move the spike at least substantially axially into the interior of the container to thereby flex the second portion of the stopper inwardly of the container to dispense fluid from the container.

2. A method in accordance with claim 1 further comprising engaging said cap body against said first portion of the stopper to compress said first portion of the stopper between the lip of the container and the cap body as said cap is moved at least substantially axially toward the container.

3. A cap adapted for use in dispensing minute portions of fluid from a container where the container has a mouth with a resilient stopper closing said mouth and the resilient stopper has an outer end with a flexible diaphragm portion extending across at least a portion of said mouth, said cap comprising:

a body portion having a first side and a second side, said second side being for contacting the outer end of said resilient stopper, a skirt extending outwardly from said body portion so as to circumferentially encircle said resilient stopper when said cap is operatively positioned on said container;

a fluid communicating spike extending through said body portion, said fluid communicating spike having a dispensing end portion extending outwardly from said first side of said body portion and a stopper penetrating end portion extending outwardly from said second side of said body portion, said stopper penetrating end portion having a penetrating tip at the distal end thereof, said fluid communicating spike defining a fluid passage therethrough from said stopper penetrating end portion to said dispensing end portion, said stopper penetrating end portion having a sufficient length such that with the cap seated on the outer end of said resilient stopper the penetrating tip at the distal end of said stopper penetrating end portion extends through the resilient stopper and emerges into the interior of the container, said stopper penetrating end portion having an outer diameter of sufficient size to extend through an aperture in said flexible diaphragm portion while forming a seal with said flexible diaphragm portion with the seal being sufficient to cause said flexible diaphragm portion to move inwardly of the container upon movement of said spike substantially axially toward said container whereby a small amount of fluid in the container can be discharged therefrom by inserting said stopper penetrating end portion through said flexible diaphragm portion until said body portion contacts said outer end of said resilient stopper, and then with the container in an inverted position applying an axial force to the cap such that the flexible diaphragm portion is flexed inwardly of the container by said seal.

4. A cap in accordance with claim 3 wherein said skirt extends outwardly from the circumference of said body portion.

5. A cap in accordance with claim 3 wherein said skirt extends outwardly from said second side a distance which is at least as great as the length of said stopper penetrating end portion.

6. A cap in accordance with claim 3 wherein said skirt is formed integrally with said body portion.

7. A cap in accordance with claim 3 wherein said penetrating tip has an inclined surface to form a penetrating point tip.

8. A cap in accordance with claim 3 wherein said skirt has a plurality of reinforcing ribs formed as a part of the skirt to provide rigidity to the skirt.

9. A cap in accordance with claim 8 wherein said ribs are equally spaced about the circumference of said skirt.

10. A cap in accordance with claim 3 wherein said body portion having a first side and a second side is a circular disk portion.

11. A cap in accordance with claim 10 wherein said skirt extends outwardly from the circumference of said circular disk portion.

12. A cap in accordance with claim 11 wherein said skirt extends outwardly from said second side a distance which is at least as great as the length of said stopper penetrating end portion.

13. A cap in accordance with claim 12 wherein said skirt and said spike are formed integrally with said circular disk portion.

14. A cap in accordance with claim 13 wherein said penetrating tip has an inclined surface to form a penetrating point tip.

15. A cap in accordance with claim 14 wherein said skirt has a plurality of reinforcing ribs formed as a part of the skirt to provide rigidity to the skirt.

16. A cap in accordance with claim 15 wherein said ribs are equally spaced about the circumference of said skirt.

17. A dispenser for use in dispensing minute portions of fluid, said dispenser comprising:

a container having a mouth, a resilient stopper closing said mouth, said resilient stopper having an outer end with a flexible diaphragm portion extending across at least a portion of said mouth; and a cap seated on the outer end of said resilient stopper, said cap comprising:

a body portion having a first side and a second side, said second side confronting the outer end of said resilient stopper, a skirt extending outwardly from said body portion so as to circumferentially encircle said resilient stopper, a fluid communicating spike extending through said body portion, said fluid communicating spike having a dispensing end portion extending outwardly from said first side of said body portion and a stopper penetrating end portion extending from said second side of said body portion toward the interior of said container, said stopper penetrating end portion having a penetrating tip at the distal end thereof, said spike defining a fluid passage therethrough from said stopper penetrating end portion to said dispensing end portion, said stopper penetrating end portion having a sufficient length such that the penetrating tip at the distal end of said stopper penetrating end portion extends through the resilient stopper and emerges into the interior of the container, said stopper penetrating end portion having an outer diameter of sufficient size to extend through an aperture in said flexible diaphragm portion while forming a seal with said flexible diaphragm portion with the seal being sufficient to cause said flexible diaphragm portion to move inwardly of the container upon movement of said spike substantially axially toward said container whereby a small amount of fluid in the container can be discharged therefrom by inserting said stopper penetrating end portion through said flexible diaphragm portion until said body portion contacts said outer end of said resilient stopper, and then with the container in an inverted position applying an axial force to the cap such that the flexible diaphragm portion is flexed inwardly of the container by said seal.

18. A dispenser in accordance with claim 17 wherein said skirt extends outwardly from the circumference of said body portion to overlie and circumferentially encircle the sides of said resilient stopper.

19. A dispenser in accordance with claim 17 wherein said skirt extends outwardly from said second side a distance which is at least as great as the length of said stopper penetrating end portion.

20. A dispenser in accordance with claim 17 wherein said skirt and said spike are formed integrally with said circular disk portion.

21. A dispenser in accordance with claim 17 wherein said penetrating tip has an inclined surface forming a penetrating point tip.

22. A dispenser in accordance with claim 17 wherein said container is a glass tube having a lip forming said mouth, and wherein said resilient stopper is a compressible, flexible rubber stopper.

23. A dispenser in accordance with claim 17 wherein said resilient stopper has a reduced circumferential portion which is inserted into the mouth of said container, and an enlarged circumferential portion which engages the uppermost surface of said lip.

24. A dispenser in accordance with claim 17 wherein a radial clearance exists between the inside surface of said skirt and said resilient stopper, thereby permitting off axis movement of the cap with respect to said container.

25. A dispenser in accordance with claim 17 wherein a void exists between said flexible diaphragm portion and said second side of said body portion.

26. A dispenser in accordance with claim 17 wherein said resilient stopper is entrapped between said body portion and said container whereby said resilient stopper is compressed upon advancement of said body portion toward the container while the flexible diaphragm portion is simultaneously flexed inwardly.

27. A dispenser in accordance with claim 17 wherein said skirt has a plurality of reinforcing ribs formed as a part of the skirt to provide rigidity to the skirt.

28. A dispenser in accordance with claim 27 wherein said ribs are equally spaced about the circumference of said skirt.

29. A dispenser in accordance with claim 17 wherein said body portion having a first side and a second side is a circular disk portion.

30. A dispenser in accordance with claim 29 wherein said skirt extends outwardly from the circumference of said circular disk portion to overlie and circumferentially encircle the sides of said resilient stopper.

31. A dispenser in accordance with claim 30 wherein said skirt extends outwardly from said second side a distance which is at least as great as the length of said stopper penetrating end portion.

32. A dispenser in accordance with claim 31 wherein said skirt and said spike are formed integrally with said circular disk portion.

33. A dispenser in accordance with claim 32 wherein said penetrating tip has an inclined surface to form a penetrating point tip.

34. A dispenser in accordance with claim 33 wherein said skirt has a plurality of reinforcing ribs formed as a part of the skirt to provide rigidity to the skirt.

35. A dispenser in accordance with claim 34 wherein said ribs are equally spaced about the circumference of said skirt.

36. A dispenser in accordance with claim 35 wherein said container is a glass tube having a lip forming said mouth, and wherein said resilient stopper is a compressible, flexible rubber stopper.

37. A dispenser in accordance with claim 36 wherein said resilient stopper has a reduced circumferential portion which is inserted into the mouth of said container, and an enlarged circumferential portion which engages the uppermost surface of said lip.

38. A dispenser in accordance with claim 37 wherein a radial clearance exists between the inside surface of said skirt and said resilient stopper, thereby permitting off axis movement of the cap with respect to said container.

39. A dispenser in accordance with claim 37 wherein a void exists between said flexible diaphragm portion and said second side of said body portion.

* * * * *